US006736530B2

(12) United States Patent
Thevenot

(10) Patent No.: US 6,736,530 B2
(45) Date of Patent: May 18, 2004

(54) IMAGE DISPLAY DEVICE

(76) Inventor: Alex J. Thevenot, 530 Westminster Ave., Venice, CA (US) 90291

( * ) Notice: Subject to any disclaimer, the term of this patent is extended or adjusted under 35 U.S.C. 154(b) by 0 days.

(21) Appl. No.: 10/155,464

(22) Filed: May 23, 2002

(65) Prior Publication Data

US 2003/0218883 A1 Nov. 27, 2003

(51) Int. Cl.[7] ..... B41C 1/00

(52) U.S. Cl. ..... 362/362; 362/367; 362/360; 362/410; 362/414; 40/564; 40/574

(58) Field of Search ..... 362/367, 360, 362/410, 414; 40/564, 574, 575, 576

(56) References Cited

U.S. PATENT DOCUMENTS

| | | | | | |
|---|---|---|---|---|---|
| 1,335,640 | A | * | 9/1920 | Beales | 40/564 |
| 2,177,204 | A | | 10/1939 | Buzick et al. | 40/131 |
| 2,680,317 | A | * | 6/1954 | Lewis | 40/564 |
| 2,823,477 | A | * | 2/1958 | Willard | 40/131 |
| 2,974,435 | A | | 3/1961 | Eschenroeder | 40/131 |
| 4,163,998 | A | | 8/1979 | Anderson et al. | 362/358 |
| 4,817,315 | A | | 4/1989 | Kammerer et al. | 40/554 |
| 5,124,900 | A | * | 6/1992 | Varey et al. | 362/352 |
| D363,139 | S | | 10/1995 | Johnson | D26/135 |
| 6,508,171 | B1 | * | 1/2003 | Georges | 101/483 |
| 6,547,419 | B1 | * | 4/2003 | Brackman | 362/253 |

OTHER PUBLICATIONS

"Assessing the Influence of Electrostatic Charge Retained on Materials", http://www.ce–mag.com/archive/02/Spring/Chubb.html.*

* cited by examiner

*Primary Examiner*—Sandra O'Shara
*Assistant Examiner*—Anabel Ton
(74) *Attorney, Agent, or Firm*—Cislo & Thomas LLP

(57) ABSTRACT

An image display device may take the form of an illuminating picture lamp providing means by which images may be illuminated by a light source on a selectable and removably attachable basis. Using a base layer of translucent material preferably circumscribed by a transparent material, an image may be slipped between the two layers and illuminated by a light source. The sheets are used to form a lampshade and are held in place about a light source, such as a light bulb, by supports threadably engaging a mounting base. The mounting base attaches to the lamp generally below the light bulb to provide stable support for the lampshade. The image display device of the present invention provides attractive and selectable means by which images may be illuminated by a light source and articles, such as lamp shades, may be decorated on a personalized basis.

22 Claims, 4 Drawing Sheets

FIG.2
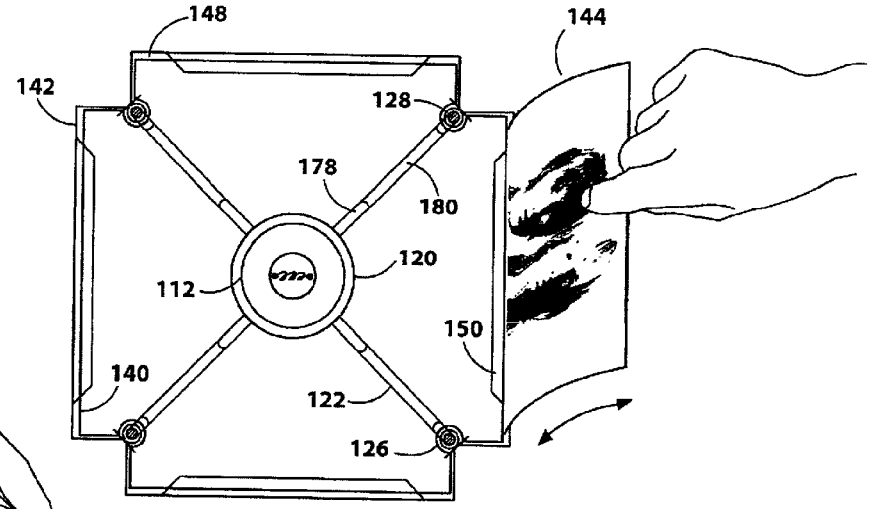
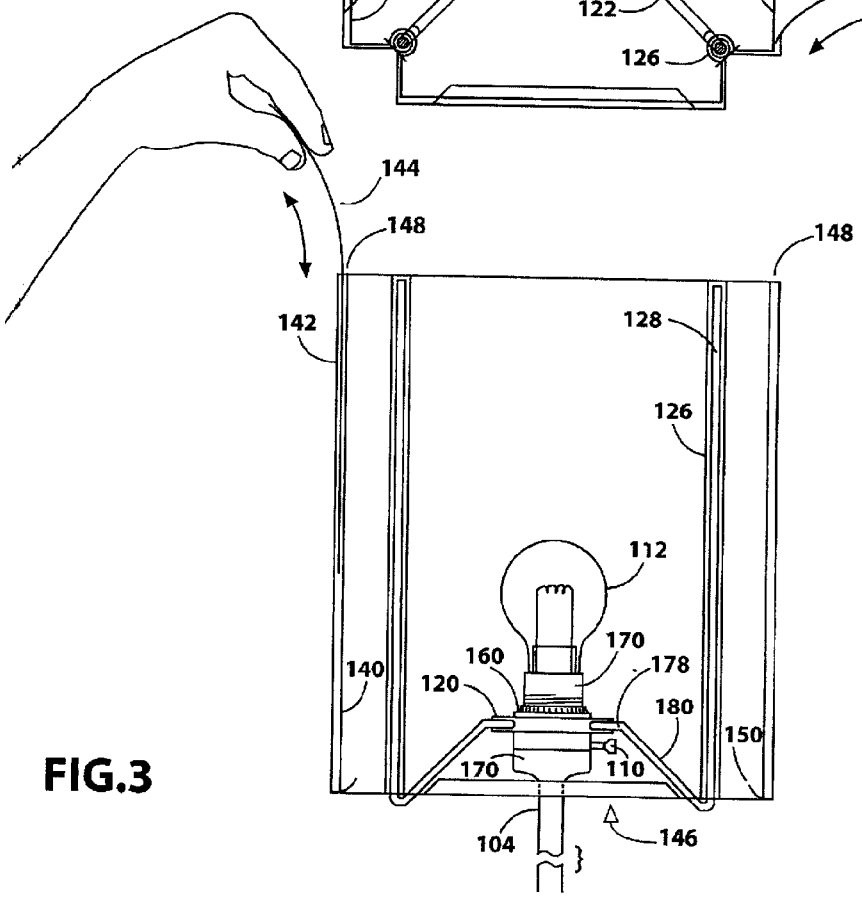
FIG.3

IMAGE DISPLAY DEVICE

BACKGROUND OF THE INVENTION

1. Field of the Invention

This invention relates to image display devices including lampshades and related devices and more particularly to an image display device that may take the form of a lampshade that enables illumination of replaceable images held by the lamp shade.

2. Description of the Related Art

Image display devices such as lampshades are used to cover illumination sources, such as light bulbs, in order to diffuse the light and to provide a more attractive appearance than a single naked light bulb attached to a post or hanging from the ceiling. Such lampshades are generally decorative and artistic in nature in order to add to the décor of the room or environment in which they operate.

Generally, image display devices such as lampshades are static in nature in that they have one single design which is used to cover the lamp until the useful life of the lampshade is over. Lampshades may be replaced, but often lamps are sold with lampshades as a combined set and the two generally operate together for the useful life of the lamp and shade combination.

Very often, lampshades are attached to a harp that extends upwardly on either side of the bulb or light. This allows the lampshade to rest upon the harp and descend over the light in order to diffuse its light. Alternatively, low weight lampshades sometimes have clips that clip directly to a light bulb, the clip generally being two thin and flexible wires sufficient to support the weight of the lampshade without adversely affecting the operation and integrity of the glass light bulb. Certain prior attempts in the art have been made to combine the use of selectable images with lampshades. These include the following patents.

U.S. Pat. No. 2,177,204 to Buzick, et al teaches a picture display panel for lampshades and discloses at Column 1 that the lampshade is of two-ply material with the outer ply being transparent and the inner ply being translucent and the shade is slotted to allow the placement of a picture or the like.

U.S. Pat. No. 2,680,317 to Lewis has been directed to a decorative lampshade and employs a lampshade having fenestration 20. Adhered or otherwise appropriately mounted on the face of background plate 21, that is presented through fenestration 20 in a objet d'art 22 in sheet form such as a pictorial print etching or the like.

U.S. Pat. No. 2,823,477 to Willard teaches a lampshade having either opaque or translucent material and behind which pictures or colored panels of translucent or transparent material may be mounted.

U.S. Pat. No. 2,974,435 to Eschenroeder is directed to a lampshade of separable double-walled construction comprising an inner wall of translucent material which has been positioned adjacent to a light source, and an outer wall which would be generally opaque and having one or more transparent image display windows whereby an image carrying sheet may be detachably mounted between the walls in alignment with the window.

U.S. Pat. No. 4,163,998 to Anderson is directed to a lampshade which is formed with the window opening in which a picture may be displayed and the picture is mounted between inner and outer of at least partially transparent sheets located against the inner surface of the lampshade.

U.S. Pat. No. 3,456,106 to Gluschkin is directed toward a frustro-conicular lampshade capable of receiving decorative or information carrying members.

Other attempts have also been made in the art, however the patents set forth above are believed to be the most pertinent of the prior art relevant to the present invention.

It would be advantageous and a contribution to the art to provide a lampshade that allowed the selectable positioning of images thereon. When the light is turned on, it will illuminate the underlying image due to the nature of the lampshade. This provides additional means by which lampshades may be esthetically used to add to the décor of a room and allow individuals to change the nature and/or style of their lampshades over time and according to their preferences.

SUMMARY OF THE INVENTION

In view of the foregoing disadvantages inherent in the known types of image display devices and lampshades now present in the prior art, the present invention provides a new image display device that allows people to select certain images on a spontaneous basis for illumination.

The general purpose of the present invention, which will be described subsequently in greater detail, is to provide unique and novel means by which lampshades may be more decorative and interactive. Additionally, lampshades may have a more dynamic role in the décor of a room due to the selectable nature of the illuminated images. Due to the many advantages and features in the lampshade of the present invention, no prior art lampshades anticipate, render obvious, suggest, or even imply the present invention whether or not such prior art lampshades are taken alone or in any reasonable combination thereof.

In the present invention, a mounting based is used to provide a base to which lampshade supports are threadably attached. The mounting base may engage a lamp stand via a central aperture.

The supports extend outwardly from the mounting base and ultimately stand or descend generally parallel from the lamp. These supports provide support for the translucent lampshade which may have folds or loops that fit over the projecting supports.

The lampshade itself generally has two layers: a translucent layer which diffuses but transmits light, and a transparent layer which minimally interferes with light. The translucent and transparent layers may be connected at a lower edge thereof so that an image may be passed between the translucent and transparent layers but is prevented from sliding through by the attachment between the two layers.

When the light bulb or other light source is activated and shines, it initially illuminates the translucent layer which diffuses the light and obscures the underlying light source for a more attractive appearance. The diffused light is then transmitted onto the image and through the transparent layer such that the image is clearly seen by someone observing the lampshade. A variety of images may be used in conjunction with the lampshade of the present invention, including photos, advertisements, or information. Consequently, individuals may decorate their living quarters, apartments, and/or houses with lamps incorporating the lampshade of the present invention and public places may use the present lampshade for informational purposes and the posting of information.

OBJECTS OF THE INVENTION

It is an object of the present invention to provide a lampshade that clearly illuminates images.

It is another object of the present invention to provide an image-illuminating lampshade that is inexpensive to manufacture.

It is yet another object of the present invention to provide an image-illuminating lampshade that is easily manufactured.

It is yet another object of the present invention to provide an image-illuminating lampshade that is easy to put into practice.

It is yet another object of the present invention to provide an image-illuminating lampshade that allows for the convenient replacement of illuminated images.

It is yet another object of the present invention to provide an image-illuminating lampshade that accepts a variety of images and image formats, dimensions, or styles.

These and other objects and advantages of the present invention will be apparent from a review of the following specification and accompanying drawings.

BRIEF DESCRIPTION OF THE DRAWINGS

FIG. 2 is a top plan view of the image display device as embodied in an illuminated picture lamp of FIG. 1 showing the introduction of an image to the lampshade.

FIG. 3 is a side elevational view of the illuminated picture lamp of FIG. 2 also showing the introduction of an image into the lampshade.

DESCRIPTION OF THE PREFERRED EMBODIMENT(S)

Figure 1:
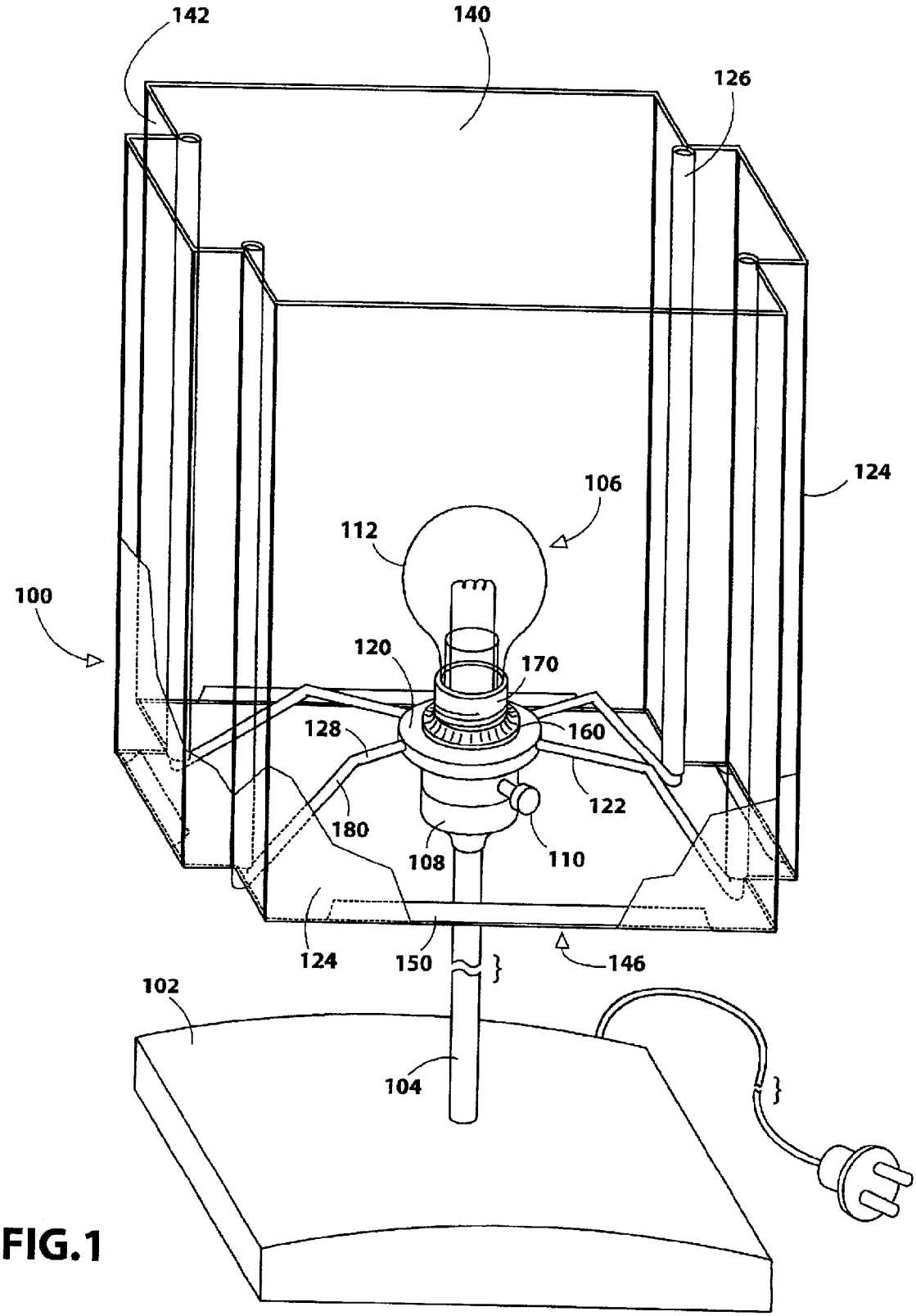
FIG. 1 is an isometric and partial cutaway view of a lamp incorporating the image display device of the present invention in the form of a lampshade.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

As shown in the figures, the image display device of the present invention may be embodied in an illuminated picture lamp that uses a lamp to provide illumination for pictures held by a lampshade. In its most general form, the image display device of the present invention may comprise a translucent sheet through which a light source may shine in order to illuminate an associated image. In a preferred embodiment, the image display device of the present invention may take the form of a lampshade for a lamp. Alternatively, the image display device of the present invention may be used for windows, wall displays, and the like.

The phrase "image display device" and "lampshade" are used interchangeably herein due to the presently-preferred embodiment of the image display device of the present invention being a lampshade. However, the image display device disclosed herein is not limited to the lampshade embodiment, but is applicable to a variety of other embodiments as will be recognized by those of ordinary skill in the art. Certain structural accommodations may be necessary in implementing the image display device of the present invention to embodiments other than a lampshade. However, these implementations and accompanying structural accommodations are achieved without undue experimentation.

The picture lamp 100 of the present invention has a base or pedestal 102 upon which a post or support 104 is generally centrally located. The post 104 supports a lamp light 106 that includes a lamp base 108, a switch 110, and a light bulb or other light source 112.

Although indicated here in an upright position, the lamp 100 may be supported as by hanging from a ceiling or projecting outwardly from a wall. The relative directions and relationships between the variety of elements are generally maintained despite the disposition or the lamp 100.

The present invention provides a mounting base 120 to which supports 122 are generally attached as by threading. The lampshade 124 is attached to the mounting base 120 by supports 122 as by a fitting or the like. As shown in FIG. 1, sleeves, loops or extending cylinders 126 of the lampshade 124 are formed in order to engage forwardly projecting portions 128 of the supports 122. With respect to the light bulb 112, the forwardly projecting portions 128 project forwardly with respect to the top of the light bulb 112 as opposed to the lamp base 102 which would be considered rearward of the light bulb 112 for purposes of description herein.

While the lampshade 124 shown in FIG. 1 has a generally square and rectangular configuration, any number of geometries or configurations may be used to achieve the present invention.

In FIGS. 2 and 3, the two pertinent layers of the lampshade 124 are indicated in more detail. An exaggerated spacing between the two layers is shown only for the demonstration of the invention. The lampshade 124 generally has an inner translucent layer 140 which serves to diffuse light radiated by the light bulb 112. The outer transparent layer 142 serves to transmit the light diffused by the inner translucent layer 140 as well as any image 144 that has been positioned between the inner translucent layer 140 and the outer transparent layer 142. Such inner positioning of an image 144 is shown in FIGS. 2 and 3 where a person is manually inserting an image 144 for illumination by the illuminated picture lamp 100 of the present invention.

In order to prevent the dislodgement or slipping of the image 144, the inner translucent layer 140 and the outer transparent layer 142 are coupled or joined 146 at their bottom. In FIG. 3, the joining 146 is achieved by means of a fold where an extending portion of the outer transparent layer 142 is folded back to form a barrier beneath the gap 148 between the inner translucent layer 140 and the outer transparent layer 142. A tail or extension 150 which shows the extending portion of the outer transparent layer 142 is shown in FIGS. 2 and 3.

Alternatively, electrostatic attraction may be used to adhere or hold the image between the translucent and the transparent layers. In such case, the bottom fold 150 may be omitted. Further, such electrostatic attraction may enable the omission of the transparent layer 142 entirely.

Figure 4:
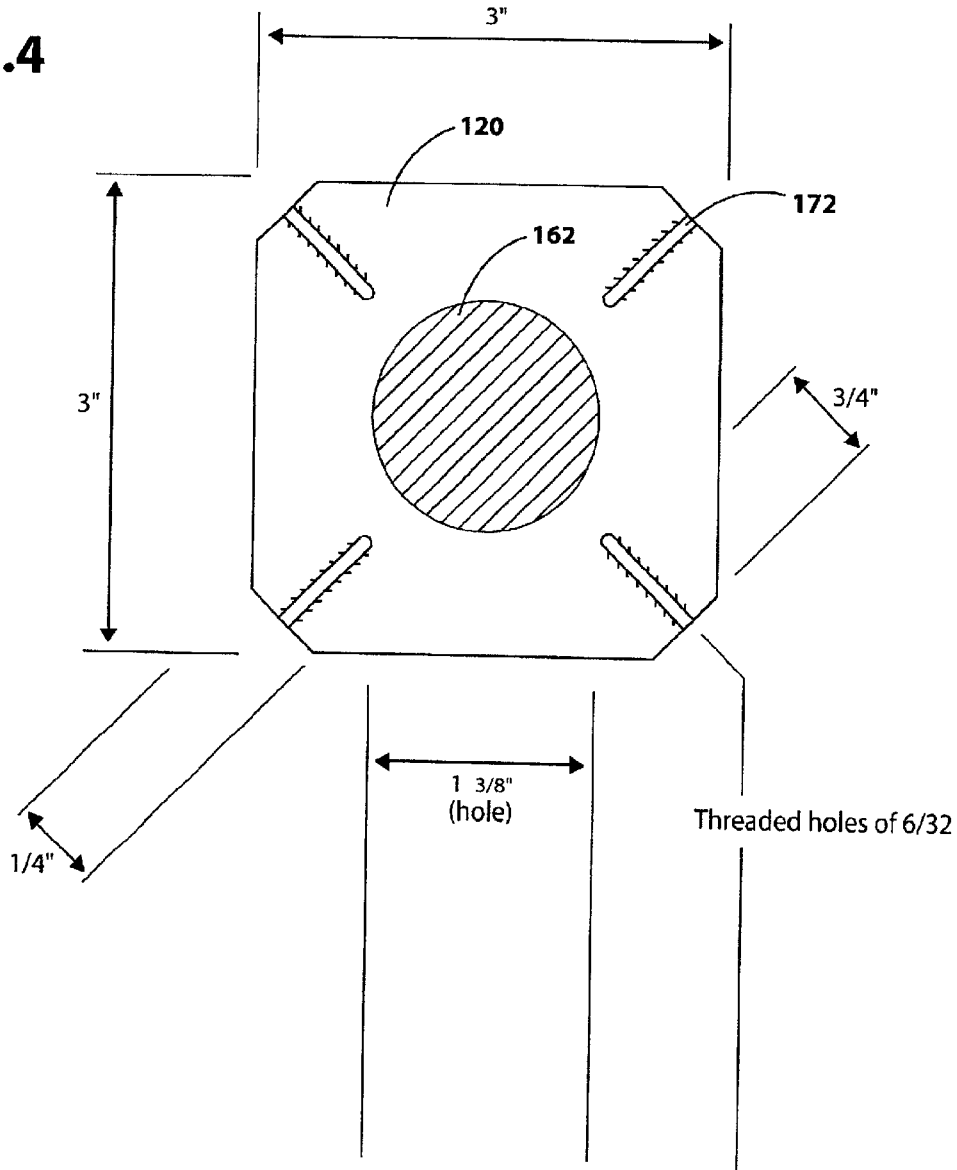
FIG. 4 is a top plan and partial cross sectional view of the mounting base used in the present invention.
Figure 5:
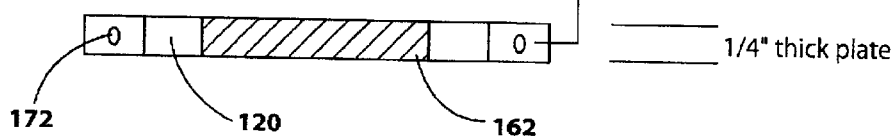
FIG. 5 is a side and partial cross sectional view of the mounting base shown in FIG. 4.

As shown in FIGS. 4 and 5, the mounting base 120 may be square or circular in nature and generally attaches below the light bulb 112 and is fitted into position by a locking nut or the like 160. The locking nut serves to hold the mounting base 120 in place and may engage the mounting base 120 through a central aperture 162. The central aperture 162 may have an outer inset bore 164 into which the locking nut 160 may fit. A smaller hole 166 allows the mounting base 120 to fit over an upper portion of the lamp base 108 whereupon the locking nut 160 may be fitted into place and the light bulb 112 screwed into the socket.

Figure 6:
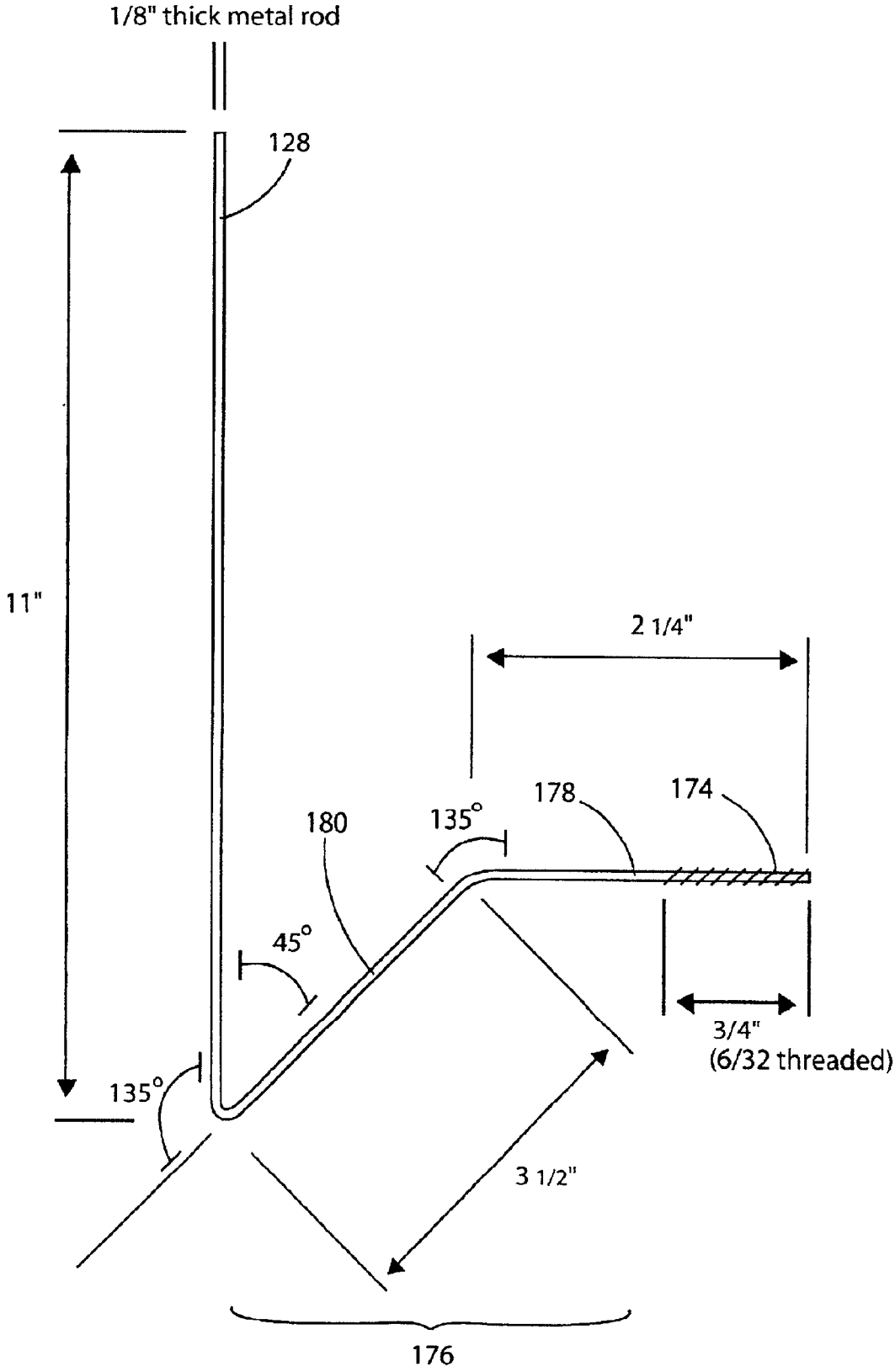
FIG. 6 is a side elevational view of a support used to support the lampshade as shown particularly in FIGS. 1 and 3.

The mounting base 120 may have a series of threaded holes 172 appropriately spaced about the perimeter of the mounting base 120. The threaded holes 172 serve to engage a proximal and similarly-threaded end 174 of a support 122 (FIG. 6). The threading may be approximately three quarters of an inch and may be disposed such that the support 122 is appropriately disposed with respect to the light bulb 112 so as to appropriately hold the lampshade 124.

The support 122 may have an outwardly extending portion 176 that allows the support to project out and away from the mounting base 120. The outwardly extending portion may project outward laterally 178 and rearwardly 180 as travel is made away from the mounting base 120 via the support 122. The rearwardly-extending portion 180 may make an angle of approximately forty-five degrees (45°) with the laterally extending portion and the coaxial threaded support end 174. The forwardly projecting portion 128 may then make an angle of approximately forty-five degrees with the rearwardly-extending portion. In this way, the rearwardly-extending portion 180 allows the lampshade to descend below the sight line of the light bulb 112 and provide a better and more attractive visual appearance for the lamp system 100 of the present invention.

While a variety of materials may be used, construction of the present invention may be achieved by the use of the following materials:

an 11"×44" backlight/translucent polyester flat sheet with a light transmittance of approximately 50%; and a sheet of 11"×44" clear polyester flat sheet.

The polyester sheets may be bent inwardly or outwardly or otherwise scored or bent in order to achieve the desired configuration. Folds, sonic welding, stitching, or heat fusion may be used to create the sleeve 126 and/or the join 146 at the bottom of the sheets 140, 142.

The light socket may be a standard ⅜" threaded bottom light socket with an outside thread for an internally threaded ring for holding a lampshade structure. A pull or turn switch may also be used.

The supports 122 may be made of metal rods approximately ⅛" in diameter and approximately 17 inches in length. One extremity is threaded with threads approximately 8/32" in height and approximately 1 inch of length at the same end. A first 45 degree bend may then be placed into the metal rod in order to distinguish between the laterally extending portion 178 and the rearwardly-extending portion 180. This would provide approximately four inches of lateral extension away from the proximal and threaded end of the support 122. The rearwardly-extending portion 180 may be approximately three inches in length.

The remaining upstanding and forwardly projection portion 128 of the support 122 may be approximately ten inches in length and bent through an angle of one hundred thirty five degrees (135°) to give a relative angle of approximately forty-five degrees between the rearwardly extending portion 180 and the forwardly extending portion 128. The rod may be painted as appropriate in order to protect the metal and provide an esthetic or attractive appearance.

The mounting base 120 may be made from a polycarbonate blank approximately three inches square and approximately ¼" thick. A central hole may be approximately 1-⅜" in diameter with an optional central outer inset bore 164 approximately 2-3/16" and reducing the thickness of the plate to approximately ⅛". The threaded holes 172 may be approximately 6/32" threads going into each of the corners of the square plate extending into the plate approximately 1 inch. As indicated in FIG. 4, the sides may be finished and cut to provide the final roughly-octagonal configuration.

Although the present invention may be used with a variety of floor, table, ceiling, and wall lamps, one of a lamp may be provided as follows.

The central lamp post or support 104 may be square or round tubing ¾" in diameter and approximately 1/16" thick. It may be cut and finished to size with threaded holes cut therein of approximately 8/32".

A solid aluminum bar may be used for the base or pedestal 102 being sufficiently heavy to support the lamp 100 being ¼" to 1" thick.

As used herein, the term "image" generally denotes and image-bearing light-transmitting material including prints, pictures, etchings, watermarks, transparencies, photos, advertisements, and information.

The unique configuration and simplicity of the lampshade permits the placement and replacement of an image in a display panel to be carried-out by a single hand with only one manipulation: pushing in or pulling out an image. It also permits easy dismantling and assembly of the part herein resulting in smaller packaging dimensions, reduction in shipping costs and fast and easy assembly by the buyer without the use of tools as well as concealment from side view angles of the hardware within the lampshade body.

While the present invention has been described with regards to particular embodiments, it is recognized that additional variations of the present invention may be devised without departing from the inventive concept.

What is claimed is:

1. An image display device for illuminating images, comprising:

a first inner wholly translucent layer for diffusing light from a light source before which the image display device is operably supported; and a second outer wholly transparent layer coupled to and in close association with said first inner wholly translucent layer;

said first and second layers being self-supporting and framelessly disposed in substantially spaced manner one from the other; whereby an image may be placed between said first inner and second outer layers, said image illuminated by said light source.

2. An image display device for illuminating images as set forth in claim 1, further comprising:

said first inner and second outer layers defining a gap therebetween into which said image may be inserted and withdrawn.

3. An image display device for illuminating images as set forth in claim 1, wherein said first inner layer further comprises:

a translucent polyester sheet having a light transmittance of approximately fifty percent (50%).

4. An image display device for illuminating images as set forth in claim 1, wherein said second outer layer further comprises:

a clear polyester sheet.

5. An image display device for illuminating images as set forth in claim 1, further comprising:

said first inner and said second outer layers joined at a lower portion thereof to form a join and ensuring said image does not travel between said first inner and said second outer layers past said join.

6. An image display device for illuminating images as set forth in claim 5, wherein said join further comprises:

a fold, said fold formed by a lower extension of said second outer layer that is folded back to cradle a lower edge of said first inner layer.

7. An image display device for illuminating images as set forth in claim 5, wherein said join further comprises:

a seam, said seam formed by attaching a lower portion of said first inner layer to a lower portion of said second outer layer.

8. An image display device for illuminating images as set forth in claim 1, further comprising:

a support, said support coupled to said light source and supporting said first inner and second outer layers.

9. An image display device for illuminating images as set forth in claim 8, wherein said support further comprises:

a spoke, said spoke coupled to said first inner and said second outer layers.

10. An image display device for illuminating images as set forth in claim 9, further comprising:

said first inner and said second outer layers formed in part as a sleeve selectably couplable to said spoke.

11. An image display device for illuminating images as set forth in claim 9, further comprising:

a mounting base coupled to said light source and supporting said spoke.

12. An image display device for illuminating images as set forth in claim 11, further comprising:

said spoke threadedly engaging said mounting base.

13. An image display device for illuminating images as set forth in claim 11, further comprising:

said mounting base coupled to said light source by a locking nut.

14. An image display device for illuminating images, comprising:

a wholly translucent polyester sheet having a light transmittance of approximately fifty percent (50%) for diffusing light from a light source before which the image display device is operably supported;

a wholly clear polyester sheet joined by a fold formed by a lower extension of said clear sheet that is folded back to cradle a lower edge of said translucent polyester sheet;

said wholly translucent and wholly clear sheets being self-supporting and framelessly disposed in substantially spaced manner one from the other to define a gap therebetween into which said image may be inserted and withdrawn;

said fold ensuring said image does not travel between said wholly translucent and said clear sheets past said fold;

a mounting base coupled to said light source by a locking nut;

at least one tubular sleeve being defined to extend upward peripherally along at least one of said wholly translucent and wholly clear sheets; and, a support threadedly engaging said mounting base and supporting said wholly translucent and clear sheets, said support having a spoke coaxially engaging said sleeve an image may be placed between said first inner and second outer layers, said image illuminated by said light source.

15. An image display device for illuminating images, comprising:

a first layer for diffusing light from a light source before which the image display device is operably supported, said first layer being generally a carrier of electrostatic charge so that electrostatic charge may be manifested by said first layer, said first layer being wholly translucent and said second layer being wholly transparent, said first and second layers being self-supporting and framelessly disposed in substantially spaced manner one from the other; whereby an image may be placed on said first layer and held thereby by electrostatic attraction, said image illuminated by said light source.

16. An image display device for illuminating images as set forth in claim 15 further comprising:

said first layer being translucent layer being generally a carrier of electrostatic charge so that electrostatic charge may be manifested by said second transparent layer; whereby an image may be placed between said first layer and said second transparent layer to be held therebetween by electrostatic attraction, said image illuminated by said light source.

17. An image display device system for illuminating images comprising:

a mounting base securable to a stand below a light, said mounting base defining an aperture through which said light may fit into said stand;

a support coupled to said mounting base and extending outwardly therefrom; and a wholly translucent surface having at least one tubular sleeve extending upward peripherally therealong, said sleeve being coaxially coupled to said support, said translucent surface being self-supporting and framelessly disposed, and being capable of supporting an image; whereby and image may be attached to said wholly translucent surface for illumination by said light.

18. An image display device system for illuminating images as set forth in claim 16, wherein said mounting base further comprises:

a threaded socket receiving said support.

19. An image display device system for illuminating images as set forth in claim 17, wherein said support further comprises:

a threaded engagement portion threadably engaging said mounting base;

an outwardly-extending portion coupled to said threaded engagement portion and extending outwardly therefrom; and a forwardly-projecting portion coupled to said outwardly-extending portion, said forwardly-projecting portion supporting said translucent surface away from said light.

20. An image display device system for illuminating images as set forth in claim 19, wherein said outwardly-projecting portion further comprises:

a laterally-projecting portion coupled to said threaded engagement portion; and a rearwardly projecting portion coupled to said laterally-projecting portion, said rearwardly projecting portion extending rearwardly and outwardly from said laterally-projecting portion; whereby said support holds said translucent surface away from said light.

21. An image display device system for illuminating images as set forth in claim 17, wherein said translucent surface further comprises:

a first and inner translucent layer, said translucent layer diffusing light from said light; and a second and outer transparent layer, said transparent layer transmitting light with minimal diffusion or opacity;

said translucent and transparent layers coupled at a first lower end and adapted to receive an image; whereby said image may be slipped between and held by said translucent and transparent layers, said image illuminated by light diffused by said translucent layer.

22. An image display device system for illuminating images, comprising:

a mounting base securable to a stand below a light, said mounting base defining an aperture through which said light may fit into said stand;

said mounting base defining a threaded socket;

said aperture being an inset aperture fitting about said stand and said mounting base secured to the stand by engagement of said outer inset bore;

a translucent surface coupled to said support, said translucent surface capable of supporting an image, said translucent surface having:

a first and inner wholly translucent layer, said wholly translucent layer diffusing light from said light; and a second and outer wholly transparent layer, said wholly transparent layer transmitting light with minimal diffusion or opacity; and said translucent and transparent layers coupled at a first lower end to extend self-supportingly and framelessly therefrom in spaced manner one relative to the other for receiving an image such that said image may be slipped between and held by said translucent and transparent layers, said image illuminated by light diffused by said translucent layer; and a support coupled to said mounting base by threadable engagement of said threaded socket and extending outwardly therefrom, said support including:

a threaded engagement portion threadably engaging said mounting base;

an outwardly-extending portion coupled to said threaded engagement portion and extending outwardly therefrom, said outwardly-extending portion having:

a laterally-projecting portion coupled to said threaded engagement portion; and a rearwardly projecting portion coupled to said laterally-projecting portion, said rearwardly projecting portion extending rearwardly and outwardly from said laterally-projecting portion such that said support holds said translucent surface away from said light; and a forwardly-projecting portion coupled to said outwardly-extending portion, said forwardly-projecting portion engaging a tubular sleeve defined peripherally upward along at least one of said translucent and transparent layers to support said translucent layer away from said light; said first and inner translucent layer and said second and outer layer being wholly transparent; whereby an image may be attached to said translucent image display device for illumination by said light.

* * * * *